United States Patent [19]

Mishra et al.

[11] Patent Number: 4,875,949

[45] Date of Patent: Oct. 24, 1989

[54] INSENSITIVE BINDER FOR PROPELLANTS AND EXPLOSIVES

[75] Inventors: Indu B. Mishra, Churchville; Lawrence J. Vande Kieft, Bel Air, both of Md.

[73] Assignee: The United States of America as represented by the Secretary of the Army, Washington, D.C.

[21] Appl. No.: 195,974

[22] Filed: May 18, 1988

[51] Int. Cl.[4] ..... C06B 45/10

[52] U.S. Cl. ..... 149/19.3; 149/19.4; 149/19.91; 149/19.92

[58] Field of Search ..... 148/19.3, 19.4, 19.91, 148/19.92

[56] References Cited

U.S. PATENT DOCUMENTS

| | | | |
|---|---|---|---|
| 3,046,168 | 7/1962 | Burkardt et al. | 149/42 |
| 3,909,322 | 9/1975 | Chang et al. | 149/19.4 |
| 3,954,528 | 5/1976 | Chang et al. | 149/19.4 |
| 4,098,193 | 7/1978 | Schroeder | 149/2 |
| 4,220,087 | 9/1980 | Posson | 102/27 R |
| 4,358,327 | 11/1982 | Reed et al. | 149/19.4 |
| 4,555,277 | 11/1985 | Scribner | 149/19.4 |
| 4,640,947 | 2/1987 | Berg et al. | 149/19.91 |
| 4,670,068 | 6/1987 | Chi | 149/19.4 |

*Primary Examiner*—Edward A. Miller

*Attorney, Agent, or Firm*—Muzio B. Roberto; Saul Elbaum; Guy M. Miller

[57] ABSTRACT

A novel binder for the treatments of explosives and propellants to produce a composition having high energy and reduced sensitivity comprising; poly (2-methyl-5-vinyl tetrazole) and a second polymer selected from the group consisting of polyethylene glycol, polyvinyl acetate, polyvinyl alcohol, polymethyl methacrylate, polyvinyledene chloride and polyvinyledene fluoride.

12 Claims, No Drawings

INSENSITIVE BINDER FOR PROPELLANTS AND EXPLOSIVES

The invention described herein may be manufactured used and licensed by or for the Government for Governmental purposes without payment to us of any royalties.

BACKGROUND OF INVENTION

This invention relates to a novel polymer binder and more particularly to a propellant and a plastic bonded explosive binder comprising a polymer blend made of polyethylene glycol and poly(2-methyl-5-vinyl tetrazole).

Efforts are proceeding to improve propellents and explosives for fulfilling current ordnance needs, e.g., to produce an explosive having high energy with reduced sensitivity. By reduced sensitivity is meant thermal stability, increased resistance to cook-off and shock initiation. As an explosive is a composite of organic binders and crystalline nitramines, the binder component should be both tough and soft, especially in the time frame of an impact. The binder has to be soft in order to avoid the comminution of energetic materials which would cause a drastic increase of surface area resulting in greatly increased reaction rates and contributing to enhanced sensitivity. If the binder is hard, a fracture would propagate through the crystalline nitramines which would increase sensitivity. By making the binder soft, the crack propagates through the soft segments and the crack tip would not initiate the nitramines. If the binder is not tough, it will fail early in the impact event thereby exposing the nitramines to the threat.

An explosive binder material must remain in the plastic or non-glassy state throughout the military temperature specification range. Otherwise, it will be brittle rather than tough and soft, and will not protect the nitramines. This is only possible if the glass transition temperature (Tg) is very low.

We have found that the sensitivity may be improved if the percent of crystalline nitramine is reduced. We have also found that by using a moderately energetic material such as PMVT as one of the energetic binder components in the blend, it is possible to impart such insensitive characteristics to the explosives thus formed without reducing their performance.

Polyethylene glycol (PEG) and poly(2-methyl-5-vinyl tetrazole) (PMVT) are used separately in solid propellants and explosives as binders. A well recognized inherent property of PEG is that it is non-energetic. While PMVT, a stereoirregular syndiotactic polymer, has some energy, it is a glassy and somewhat brittle material. Both of these materials have deficiencies when used independently. PEG has low density, i.e., 1.1 g/cc, but has both hard and soft segments. PMVT is a little more dense, i.e., 1.28 g/cc. An ideal binder should have the following characteristics:

(a) energetic, tough and soft (b) capable of wetting crystalline nitramine and other explosives, and (c) capable of dissolving large proportions of plasticizers without exudation.

Attempts have been made to solve the deficiencies with a designer binder by co-polymerizing two or more component polymers, thereby, incorporating the characteristics of the constituent polymers. An example is the Kraton binder having widespread use in explosives. Kraton is a block co-polymer of styrene and butadiene. Butadiene has a low Tg, and provides the "soft" segment. Styrene has more crystalline brittle segments and has a high Tg. When the two polymers are converted to the block co-polymer Kraton, there is evidence of the characteristics of both polymers in the binder. While Kraton absorbs more than three times its volume of plasticizer without exudation, it possesses low density and does not wet explosives satisfactorily.

OBJECTS OF THE INVENTION

It is an object of the present invention to provide and disclose a polymer blend comprising PEG and PMVT.

It is a further object of the present invention to provide and disclose a novel composition of matter comprising an explosive and polymer binder having a reduced sensitivity.

It is a further object of the present invention to provide and disclose a novel composition of matter comprising a propellant and polymer binder having a reduced sensitivity.

Other objects and a further understanding of the invention may be ascertained from the following description and claims.

SUMMARY OF THE INVENTION

The present invention provides a solution to the prior art problems. By addition of both polyethylene glycol and poly(2-methyl-5-vinyl tetrazole) in equimolar ratios we have obtained enhanced density over what would be expected if the two mixed without interaction. Upon intimate mixing there is a volumetric contraction which results in an increase of density. The two binders are mutually soluble resulting in the crystalline parts becoming amorphous, and a single Tg corresponding to a polymer blend appears. As a result, this blend provides both softness as well as toughness. As a consequence of improvement at a molecular level, the utilization of this blend in an explosive results in a significant improvement of the impact sensitivity of the explosive.

PEG and PMVT easily form a compatible blend with unusual but desirable characteristics. We are led to conclude that this blend occurs by the formation of an interpenetrating network through hydrogen bonds between the active methine hydrogen of PMVT and the C—O—C oxygen atom of PEG. We further conclude that the blend formation results in a decrease in volume and consequent increase in specific energy. There is also a reduction in the crystalline portions of PEG and PMVT until crystallinity completely disappears when a true blend is formed. The structural formula of a PEG-PMVT polymer blend is shown below:

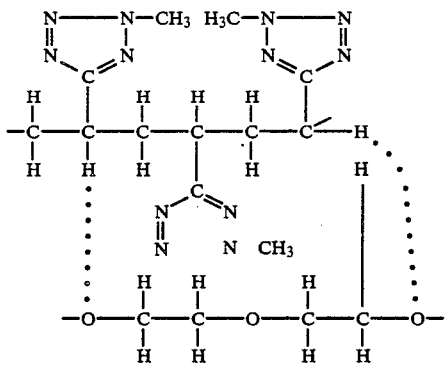

The blend is prepared by mixing equimolar amounts of the two polymers in a solvent such as acetonitrile or by precipitation from a solution of PEG and PMVT in acetonitrile under carbon dioxide at high pressure. This polymer blend dissolves large proporations of energetic plasticizers such as Trimethylolethane trinitrate (TMETN), bis (2,2-dinitropropyl) acetal/formal (BDNPA/F) and triethyleneglycol dinitrate (TEGDN). This further lowers the Tg of the blend.

PMVT has been known for over 25 years. PMVT is precipitated out of the monomer solution in benzotrifluoride by a free radical reaction. It has the following structure:

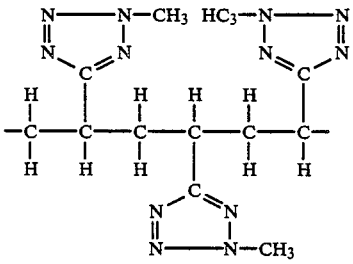

Neither PEG nor PMVT, separately, are suitable for propellants or plastic bonded explosives. Thus, a blend of PEG and PMVT provides a significant alteration of normally undesirable characteristics of PEG as well as PMVT and a new and desirable character emerges. This is unexpected as the blend offers a significant improvement in the state-of-the-art binder technology for propellants and plastic bonded explosives. It was found that the combination of polypropylene glycol (PPG) with PMVT does not form a polymer blend.

EXAMPLE 1

To a boiling solution of 3 g of PEG E-1000 (polydisperse, molecular weight 1000), 5 g of PMVT was added in small proportions. The mixture was stirred continuously for an additional 10 minutes after the PMVT had dissolved while still on moderate heat. The solution of the polymers was next dried slowly by spreading over a glass plate by rolling a rod wound with wire through a puddle of the syrup. A thin, transparent, non-crumbly film was formed giving the preliminary indication that the two polymers formed a compatible blend. The solution of the polymers was cast into a flat dish and evaporated slowly. The resultant film was dried in a vacuum oven. The dried film showed a shift of Tg by about 20° C. (DSC), i.e. from −25° C. for PEG to 4° C. The product was subjected to an infrared sprectrum analysis. A comparision of the features of PMVT with the polymer blend, is set forth below. This analysis indicated that C—H . . . O (of the C—O—C) hydrogen bonding had formed. The density of polymer blend was found to be 1.226:

| Assigned modes | PMVT $cm^{-1}$ | Polymer blend $cm^{-1}$ |
|---|---|---|
| C—H stretching vib. | 2965 | 2935 |
| C—H bending | 1471 | 1496 |
| C—O—C symmetric | 1060 | 1040 |

EXAMPLE 2

The proceedure of Example 1 is repeated. After the PEG and PMVT had dissolved, the solution was evaporated to nearly a syrupy consistency. The source of heat was removed and cold hexane (at 0° C. or below) added. The mixture was agitated rapidly. A polymer blend precipitated. The density of the blend, as well as its Tg and the infrared spectrum were the same as in Example 1.

EXAMPLE 3

The procedure of Example 1 was repeated. The PEG-PMVT solution was evaporated. When most of the solvent was removed, a trifunctional isocyanate (Desmodour N100), a Cyanourate of Trimethalol Propane from Mobay chemical, or (Mondour CB-60) was added in quantity to maintain NCO/OH of 0.8 to 1.0. The material was evaporated to dryness and then heated in a vacuum oven at 60° C. overnight. The heating was continued without the vacuum at a temperature not exceeding 70° C., and cured in an oven for three to five days. The cured polymer blend has a straw yellow color and a Tg of −4° C. This compares with a Tg of −22° C. for cured PEG.

EXAMPLE 4

To a solution of PEG and PMVT in acetonitrile, prepared in a manner shown in Example 1, Hexahydro-1,3,5 trinitro-1,3,5 triazine (RDX) was added so as to conform to the composition shown below:

| MATERIAL | PERCENT COMPOSITION |
|---|---|
| PEG | 3.3–10 |
| PMVT | 5.7–18 |
| BDNPF/A | 0.0–15 |
| RDX | 91.0–57 |

The slurry was well mixed and precipitated by adding hexane in the cold as in Example 2. In the alternative, a curative may be added and the solvent removed as in Example 3. The light colored explosive was next subjected to sensitivity testing. Using a Type 12 drop weight tester with a 2.5 kg drop weight, an impact sensitivity of 1.32 meters was observed. The impact sensitivity data of several other explosives are given below for comparison:

| EXPLOSIVES | 50% POINT IN METERS |
|---|---|
| 1. TNT | 1.48 |
| 2. $A_3$ | .8 |
| 3. Comp B | .49 to .8 |
| 4. PEG-PMVT blend | 1.32 |

-continued

| EXPLOSIVES | 50% POINT IN METERS |
|---|---|
| with 91% RDX | |

Composition 2 ($A_3$) comprising 91% RDX and 9% of a hydrocarbon wax,is an explosive in widespread use. From the above data, it is seen that the explosive of the present invention comprising a PEG-PMVT blend with 91% RDX (Composition 4) is less sensitive than Composition 2, although it possesses higher energy due to the employment of an energetic binder.

EXAMPLE 5

5g of PMVT were added to a boiling solution of 5 g of Polypropylene glycol (PPG), in acetonitrile. A transparent solution was formed when the PMVT dissolved. Upon the slow evaporation of the solution, PMVT precipitated leaving behind liquid PPG. As the formation of a blend was unsuccesful in this experiment, it was repeated using the same quantity of PPG but adding only 0.5 g PMVT. The PMVT still phase separated. This experimentation indicates that PPG and PMVT do not form a polymer blend, whereas PEG and PMVT do. Accordingly, the formation of a polymer blend by PEG amd PMVT is unexpected.

Explosive compositions have been prepared using other nitramines such as octahydro-1,3,5,7-tetranitro-1,3,5,7 tetrazine (HMX) and aminodinitrobenzofuroxane (ADNBF). In such instances, a reduction in sensitivity was observed.

Experimentation has also been performed with propellants. These propellant compositions contained, for example:

(a) Up to 70% of a mixture of 100 to 75% nitramines such as RDX and HMX and 0–25% ammonium nitrate taken together (b) a polymer blend containing 1:1.5 to 1:2 parts by weight of PEG:PMVT, and (c) from 0–20% plasticizer by weight A reduction of sensitivity was observed using PEG-PMVT as the binder in the propellants compared with conventional inert binders such as polybutadines, polyurethanes, and poly(fluorocarbons).

Having described our invention, we claim:

1. A novel polymer binder for explosives composed of poly (2-methyl-5-vinyl tetrazole), and a second polymer, of about 30%–50% by weight of the blend, selected from the group consisting of polyethylene glycol, polyvinyl acetate, polyvinyl alcohol, polymethyl methacrylate, polyvinylidene chloride and polyvinylidene fluoride.

2. A novel binder in accordance with claim 1 wherein the second polymer is polyethylene glycol.

3. A method for the preparation of an explosive composition of matter comprising:

(a) dissolving poly (2-methyl-5-vinyl tetrazole) in acetonitrile (b) adding a second polymer dissolved in acetronitrile, which is selected from the group consisting of polyethylene glycol, polyvinyl acetate, polyvinyl alcohol, polymethyl methacrylate, polyvinylidene chloride and polyvinylidene fluoride dissolved in acetonitrile in an amount that forms a miscible and compatible polymer blend which is stable within the temperature range of about −50° C. to about 100° C.

(c) adding an explosive selected from the group consisting of hexahydro-1,3-5-trinitio-1,3,5-triazine; octohydro-1,3,5,7-tetranitro-1,3,5,7-tetrazocine; and aminodinitrobenzofuroxane, in a percent by weight of about 55 to 91

(d) heating to a temperature of about 85° C. with agitation (e) adding a cross-linking agent selected from the group consisting of isophoro diisocyanate, toluene diisocyanate and hexamethylene diisocyanate (f) substantially removing all of the acetonitrile and precipitating the resultant mixture to form a coating of the polymer blend on the explosive.

4. A method in accordance with claim 3 wherein the second polymer is polyethylene glycol.

5. A method in accordance with claim 3 wherein the second polymer is within the range of about 30 to 50% by weight of the polymer.

6. A method in accordance with claim 3 wherein the polymer blend comprises 9–28% by weight of the composition.

7. An explosive composition of matter comprising (a) an explosive selected from the group consisting of hexahydro 1,3,5-trinitro-1,3,5-triazine and octahydro-1,3,5,7-tetranitro-1,3,5,7 tetrazocine in a weight ratio of around 55 to 91%.

(b) and a polymer binder made from a blend comprising poly(2-methyl-5-vinyl) tetrazole, and a second polymer selected from the group consisting of polyethylene glycol, poly-vinyl acetate, poly-vinyl alchol, polymethyl methacrylate, polyvinylidene chloride and polyvinylidene fluoride in a weight ratio of 30 to 50% of the blend, and (c) a cross-linking agent.

8. An explosive composition of matter in accordance with claim 7 wherein the second binder is polyethylene glycol.

9. A composition of matter in accordance with claim 7 wherein a cross-linking agent is selected from the group consisting of isophorone diisocyanate, toluene diisocyanate, hexamethylene diisocyanate, and isocyanourate of trimethalol propane.

10. A propellant composition of matter comprising:

(a) up to 70% of a mixture comprising a nitramine, and ammonium nitrate (b) a polymer blend having a ratio of 1:1 to 1:2 parts of PEG-PMVT, and (c) 0–20% of a plasticizer, all percentages being on a weight basis.

11. A propellant composition in accordance with claim 9, wherein the nitramine is selected from the group consisting of hexalhydro 1,3,5-trinitro-1,3,5-triazine and octahydro-1,3,5,7 tetranitro-1,3,5,7-tetrazocine.

12. A propellant composition in accordance with claim 11, wherein the propellant comprises 75% nitramine and 25% ammonium nitrate by weight.

* * * * *